US005299603A

United States Patent [19]

Reiter

[11] Patent Number: 5,299,603

[45] Date of Patent: Apr. 5, 1994

[54] METHOD OF WEAVING BELT MATERIAL ON A NEEDLE BELT LOOM

[75] Inventor: Erich Reiter, Mutlangen, Fed. Rep. of Germany

[73] Assignee: Johann Berger, Alfdorf, Fed. Rep. of Germany

[21] Appl. No.: 927,664

[22] PCT Filed: Mar. 8, 1991

[86] PCT No.: PCT/EP91/00439

§ 371 Date: Aug. 31, 1992

§ 102(e) Date: Aug. 31, 1992

[87] PCT Pub. No.: WO91/14814

PCT Pub. Date: Oct. 3, 1991

[30] Foreign Application Priority Data

Mar. 23, 1990 [DE] Fed. Rep. of Germany ... 4009455

[51] Int. Cl.[5] ..... D03D 13/00; D03D 35/00

[52] U.S. Cl. ..... 139/431; 139/22

[58] Field of Search ..... 139/188 R, 441, 431, 139/432, 22, 383 R

[56] References Cited

U.S. PATENT DOCUMENTS

| | | | |
|---|---|---|---|
| 1,622,542 | 3/1927 | Renshaw | 139/188 |
| 4,007,763 | 2/1977 | Sellers et al. | 139/432 X |
| 4,421,142 | 12/1983 | Muller | 139/383 R |
| 4,750,529 | 6/1988 | Watanabe . | |

FOREIGN PATENT DOCUMENTS

| | | |
|---|---|---|
| 0021104 | 1/1981 | European Pat. Off. . |
| 0147621 | 7/1985 | European Pat. Off. . |
| 390073 | 2/1924 | Fed. Rep. of Germany . |
| 2512617 | 10/1975 | Fed. Rep. of Germany . |
| 2637618 | 10/1979 | Fed. Rep. of Germany . |
| 3345508 | 6/1985 | Fed. Rep. of Germany . |
| 3106684 | 3/1989 | Fed. Rep. of Germany . |
| 2021308 | 7/1970 | France . |
| 2388908 | 11/1978 | France . |
| 274805 | 7/1951 | Switzerland . |
| 572999 | 2/1976 | Switzerland . |
| 598382 | 4/1978 | Switzerland . |

*Primary Examiner*—Andrew M. Falik

*Attorney, Agent, or Firm*—Kane, Dalsimer, Sullivan, Kurucz, Levy, Eisele & Richard

[57] ABSTRACT

Weaving belt material on a needle belt material loom with oppositely operating weft needles by insertion into a common shed. The heads of the oppositely inserted weft loops are secured by two rows of stitches arranged at the outer border of the belt material.

5 Claims, 5 Drawing Sheets

METHOD OF WEAVING BELT MATERIAL ON A NEEDLE BELT LOOM

SUMMARY OF THE INVENTION

The invention relates to a method for weaving belt material on a needle loom with two weft needles, that is to say weft loop inserting needles, operating in opposite directions. Such looms are known, see for instance the German patent specification 390,073.

The present invention is intended to provide a method for manufacturing belt material in a form more particularly suitable for seatbelts. In the case of such belts high transverse rigidity is desirable so that on the one hand the belt snugly engages the body of the person to be secured while on the other hand it smoothly runs through the belt fittings and may be readily wound up. In this respect the belt should wind up as a minimum sized coil so that space is saved.

High transverse rigidity may be achieved by the use of monofilament weft, which is relatively hard. The hardness of such a monofilament weft is however responsible for its lateral bends forming rough borders to the belt material which have an objectionable chafing action that is to say they produce an abrasive effect on the skin and clothing of the person using the belt.

The aim is now to provide a method for weaving belt material with the use of monofilament weft which ensures that border reversal bends of the monofilament weft do not project from the borders of the belt. This may be achieved in principle by having border portions of the belt material woven with a multifilament weft like the main part of the belt. Then however there is the problem of securing the rows of heads of the monofilament and of the multifilament weft and furthermore producing a belt material which makes a symmetrical impression, that is to say of which both border portions at the most hardly differ from each other.

The center part of the belt material is woven jointly by the two weft needles, of which one supplies a multifilament weft which furthermore extends over the width of the border portions while the other weft needle supplies a thread, which only forms the center part of the belt material. This latter thread is preferably a monofilament thread. If desired it is however possible in place of it to use a multifilament thread which is however stiffer. The two border portions are only woven by one of the two weft needles, for which purpose the warp threads of the two border portions are used to form a partly open shed each, (and more particularly a half open shed) through which only one of the two weft needles is moved, while the other weft needle is always operated outside it, that is to say above or underneath this partly open shed. The heads of the weft loops woven with the border portion warp threads are secured by a row of stitches constituted by an auxiliary thread and arranged externally on the border portion. On the contrary the heads of the weft loops, which are only woven with the center part warp threads, are secured by a row of stitches constituted by further auxiliary thread, which is arranged at the outer border of the center part and at the inner border of the adjacent border portion, that is to say further inside the belt material than the first mentioned row of stitches.

It has surprisingly been found that despite this asymmetrical structure the belt material creates a symmetrical impression and the lack of symmetry is concealed to the eye.

A proposal has been made in the European patent publication 0 147 621 B1 to weave belt material having a center part, which is woven using monofilament and multifilament weft, whereas the one border portion is only woven with the one multifilament weft thread. The intention is to weave such a belt material with separate needles or shuttles. Although it is possible to weave such belt material with such border portions using shuttles, such a method of weaving is excessively slow and hence expensive. The said patent publication does not provide any teaching as to how belt material is to be woven using weft needles and having two border portions which are only woven from the single, that is to say multifilament thread.

Preferably auxiliary threads are utilized, which have approximately half the weight, expressed in dtex, of the two weft threads of the same thickness to ensure that the row of stitches protrude as little as possible.

The invention furthermore relates to a method of weaving belt material on a needle belt material loom with oppositely operating weft needles, the belt material not having any border portions and being woven by both weft needles by insertion into a common shed. This form of the invention is intended to provide a completely symmetrical belt material, which is able to be utilized in all cases in which border portions are unnecessary or are undesired.

In order to make possible this method in accordance with the invention the heads of the oppositely inserted weft loops are secured by two rows of stitches each constituted by an auxiliary thread. These rows of stitches are arranged at the outer borders of the belt material.

It is an advantage to use relatively thick auxiliary threads so that it is possible to be certain that the heads, which are retained by the rows of stitches, of the weft loops do not protrude to the outside and soft outer borders of the belt material are formed.

BRIEF DESCRIPTION OF THE INVENTION

Working embodiments with further features of the invention will now be described in the following account with reference to the figures.

Figure 3:
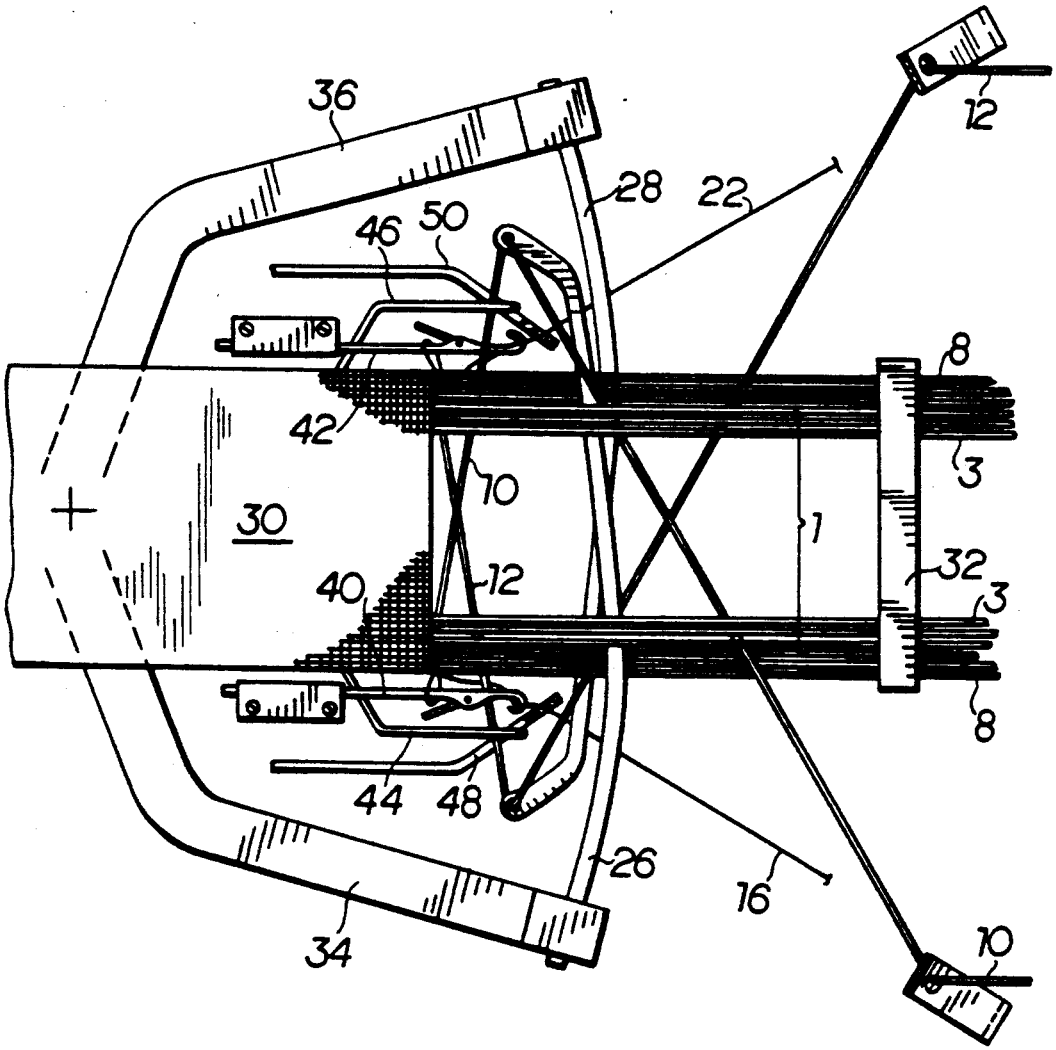
FIG. 3 shows the same arrangement with the weft needles swung inwards as far as they will go.
Figure 4:
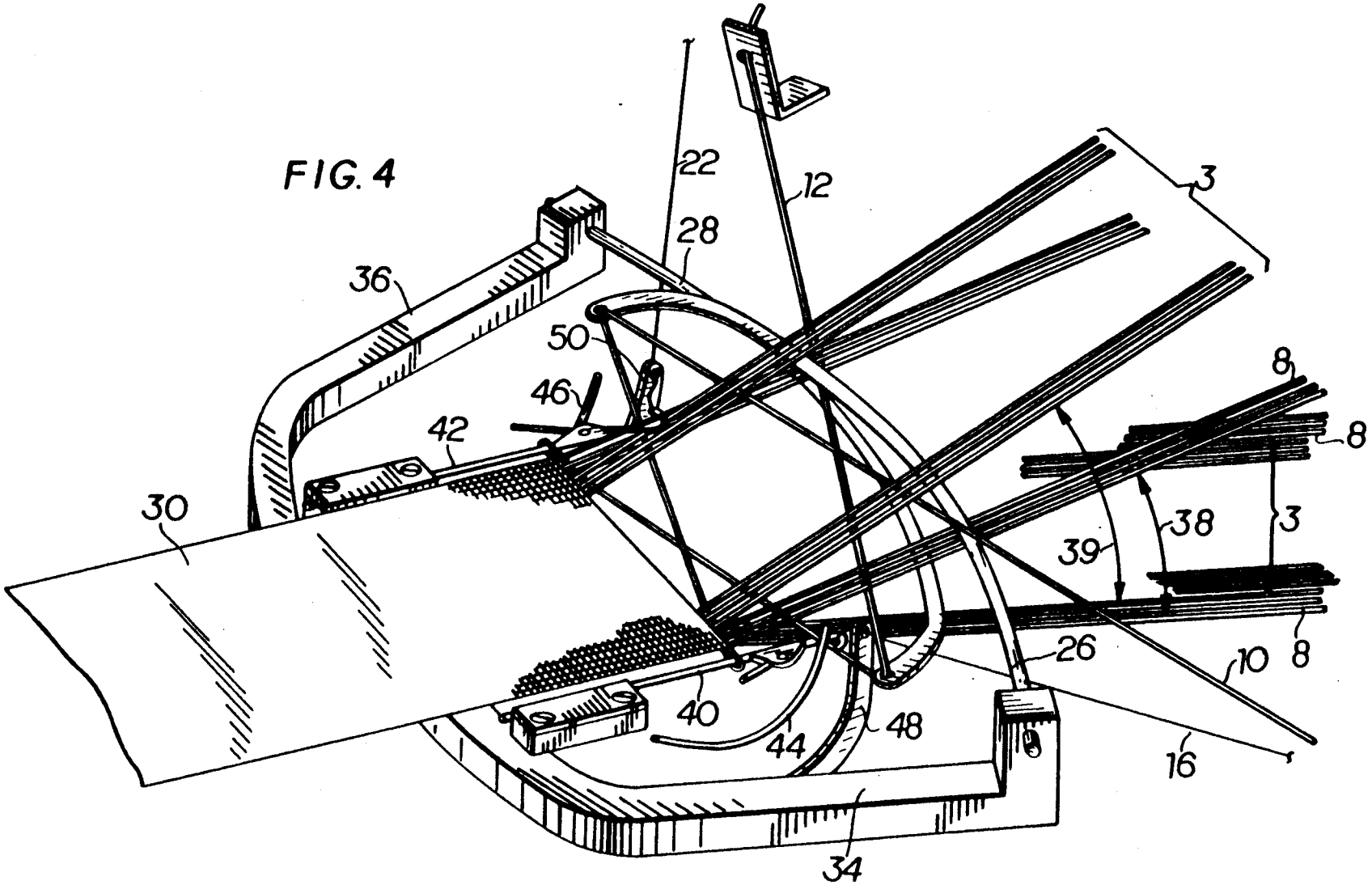

FIG. 4 the same arrangement as in FIG. 3 but in perspective.

Figure 5:
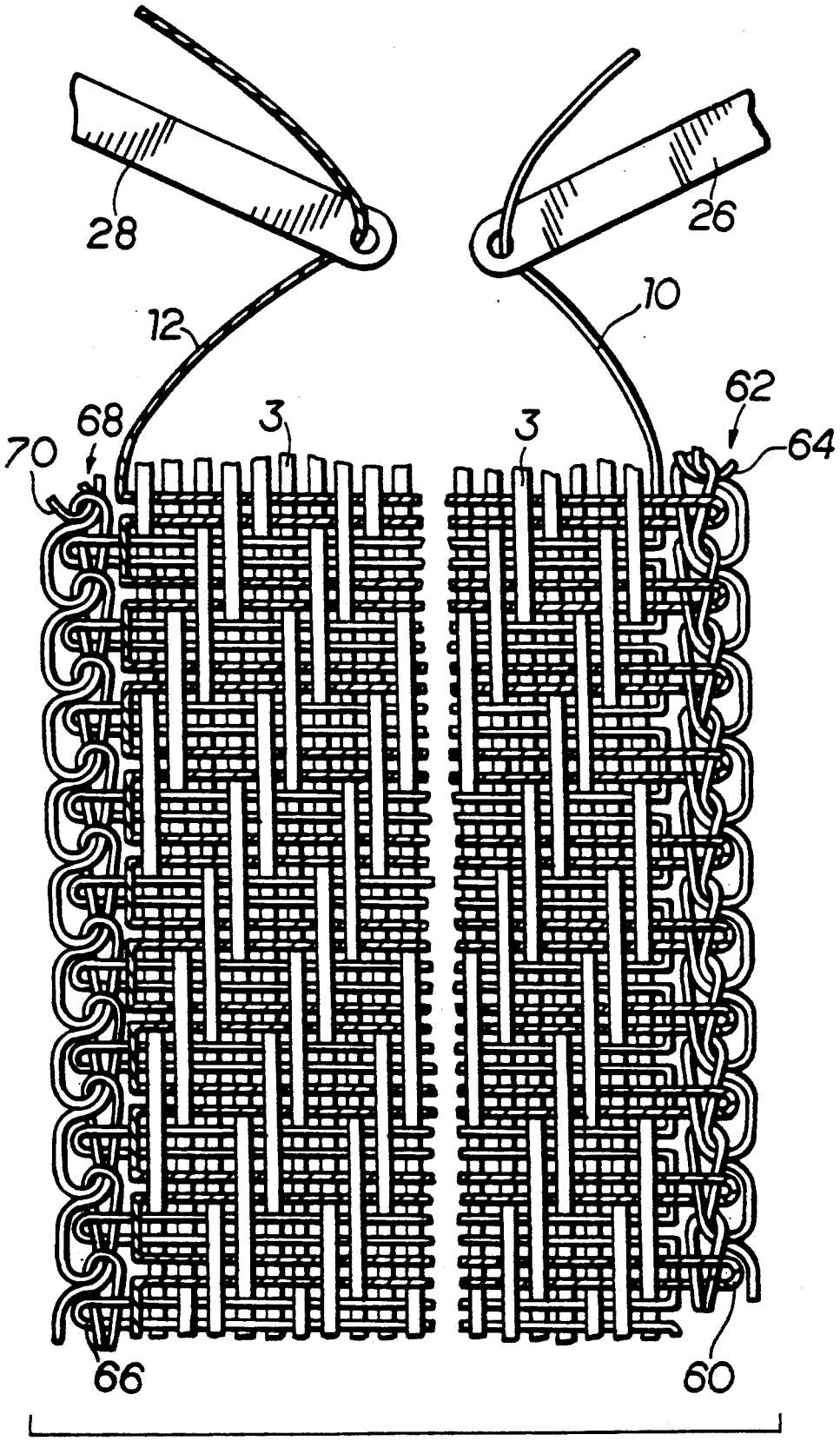

FIG. 5 shows belt material in plan without border portions in accordance with a second working embodiment of the invention, in which the center is broken away to a large extent, and the free ends of two weft needles and weft threads supplied by the same

DESCRIPTION OF THE PREFERRED EMBODIMENTS

Figure 1:
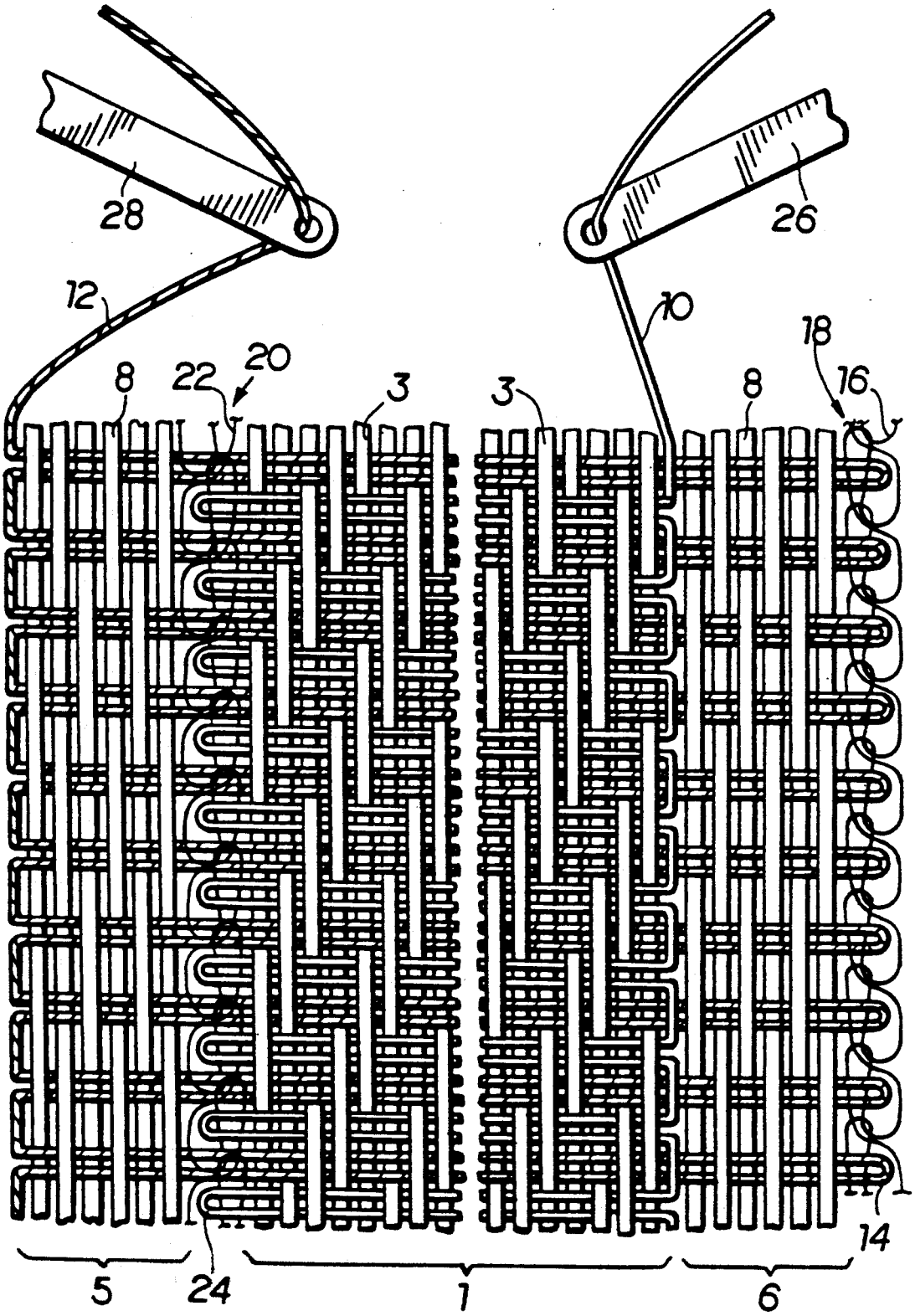
FIG. 1 is a plan view of belt material with border portions in accordance with a first working embodiment of the invention, whose center part is broken away to a large extent, and the free ends of two weft needles and the weft threads supplied by them.

The belt material illustrated in FIG. 1 possesses a center part 1 with warp threads 3, a left border portion 5 and a right border portion 6, both having warp threads 8. The warp threads 8 of the border portions may, as illustrated, have the same thickness as the warp threads 3 of the center part, but they may also be thinner. Two weft threads are employed, that is to say a multifilament weft 12, which runs over the full width of the belt material, that is to say including the center part, and is woven in the two border portions. Furthermore a further weft thread 10 is used, which is only woven with the warp threads of the center part and does not extend into the two border portions. This weft is preferably a monofilament one. However it is possible to use multifilament therefor as well. In the following however the weft thread 10 is always referred to as a monofilament.

The multifilament weft thread 12 constituting the two border portions 5 and 6 forms a row of heads 14, on the right, which are secured with an auxiliary thread 16 with the formation of a row 18 of stitches to prevent them being frayed. This row of stitches is right on the outside adjacent to the border portion 6.

The monofilament weft 10 is secured by a further row 20 of stitches. This row of stitches is produced using an auxiliary thread 22 and secures the row of heads 24, which is formed by the monofilament weft 10. The row 20 of stitches is arranged at the limit between the center part 1 and the left border portion 5,, that is to say somewhat inside the fabric of the belt material. The monofilament weft 10 is inserted by a right weft needle (or more exactly a weft loop inserting needle) 26, while the multifilament weft 12 is inserted by a left weft needle 28. Only the outermost ends of the two weft needles are illustrated in FIG. 1.

Figure 2:
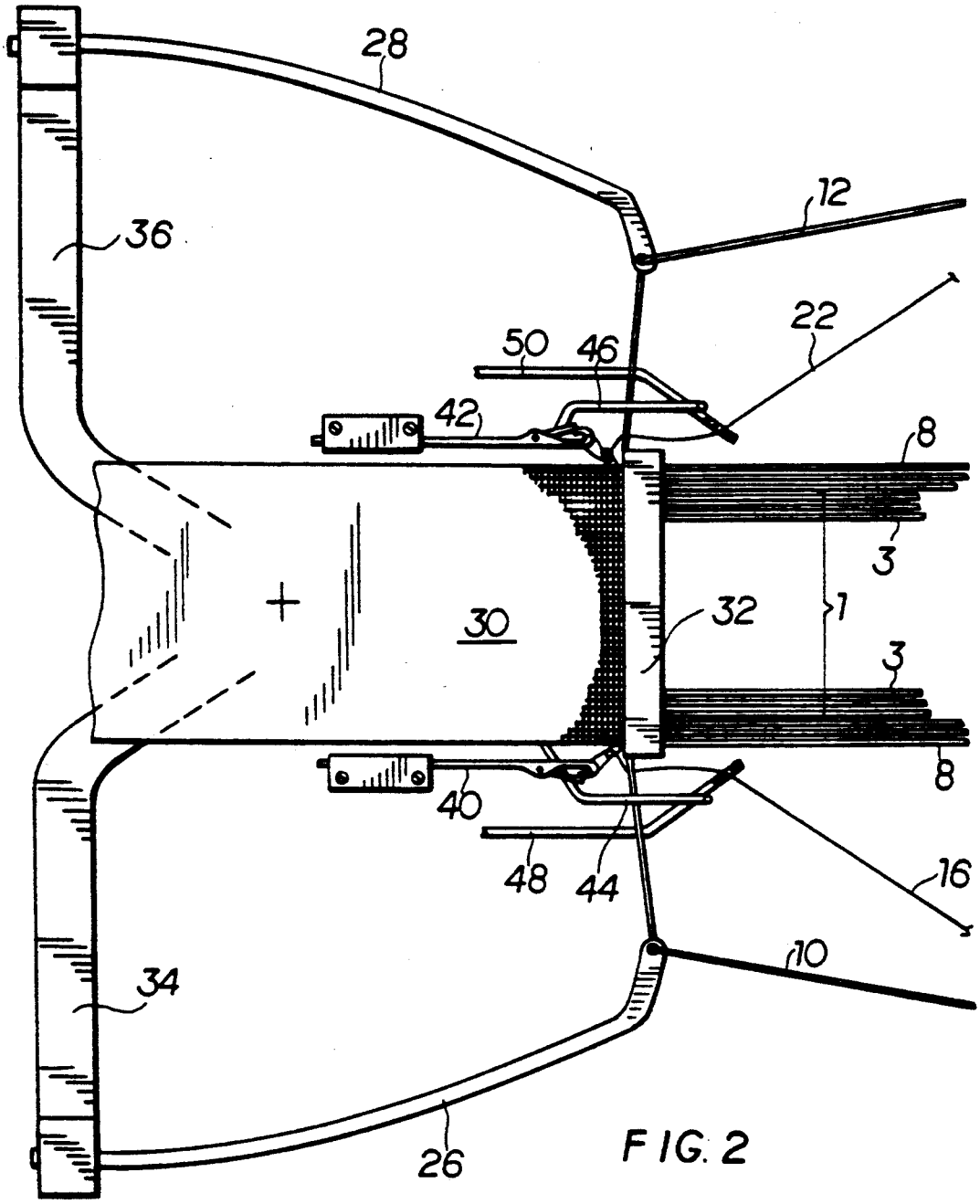
FIG. 2 is a diagrammatic plan view of the parts, which are significant here, of a needle belt loom with the weft needles swung out to the maximum extent.

FIGS. 2 through 4 show the parts which are significant in the present case of a belt material loom fitted with oppositely moving weft insertion needles 26 and 28. The two weft needles 26 and 28 are able to be moved inwards and outwards by their arms 34 and 36 which are moved by known means, not illustrated. The finished belt material 30 will be seen on the left and on the right the warp threads 3 of the center part 1 are visible. The loom has a reed 32. The two weft needles 26 and 28 are guided by two arms 34 and 36 pivoting about vertical axes. The weft needle 26 is guided by its arm 34 above the weft needle 28. As will be more particularly seen from FIG. 4, a partly open shed 38 (and more particularly a half open one) is formed by the border portion warp threads 8 on the right, that is to say to the front in FIG. 4, such half shed approximately being equal to the lower half of a main shed 39 formed of the warp threads 3 of the center part. An identical half open shed is formed to the rear in FIG. 4, that is to say on the left border. The weft needle 28, which supplies the multifilament weft 12, is guided through these two partly open sheds 38, formed by the border portion warp threads 8, and the main or fully open shed 39 so that its weft loops are woven with all warp threads. On the contrary the weft needle 26 is moved in the full or main shed 39 above the two partly open sheds 38 so that the weft loops supplied by it, of the monofilament weft 10, are only woven with the warp threads 3 of the center part but on the other hand not with the border warp threads 8.

The loom has a knitting needle 40 and 42 each to the left and to the right of the weaving zone and arranged to be swung towards the away from the belt material by means, which are not illustrated here, as will be seen from a glance at FIGS. 2 and 3. The heads of the knitting needles 40 and 42 are directed outwards and twisted through approximately 10° upwards in relation to a horizontal plane. To the right and to the left of the position of weaving and clear of the path of the knitting needles there is a respective upwardly bent latch holding wire 44 and 46 fixedly mounted in place. The two auxiliary threads 16 and 22, which serve for the production of the two rows 18 and 20 of stitches (see FIG. 1) are guided by two thread guides 48 and 50. These thread guides are able to pivot about their left end, not illustrated, about horizontal axes so that their eyes for the auxiliary threads are able to be pivoted upwards and downwards.

It is preferred to use weft thread of approximately 550 dtex and auxiliary thread of approximately 280 dtex.

During production of the belt material after beating up with the reed 32 the main shed 39 for the center part and the two partly open sheds 38 for the border portions are changed over. Then synchronously the two insertion needles 26 and 28 are moved inwards from the left and the right. As soon as the maximum pivot stroke position illustrated in FIGS. 3 and 4 has been approximately reached, the auxiliary threads 16 and 22 are moved by the two thread guides 48 and 50 through a generally trapezoidal area, which is defined by the outer ends of the weft needles 26 and 28, the outermost border warp threads 8 and the weft threads 10 and, respectively, 12 coming from the fabric. The auxiliary threads 16 and 22 are in this case inserted into the heads of the knitting needles 42 and 44. During the following return movement outwards of the weft needles, the heads, which are being formed of the weft threads 10 and 12, are knittingly joined by the auxiliary threads 16 and 22 with the rows 18 and 20 of stitches being formed. The latch retaining wires 44 and 46 ensure in a conventional manner that after knocking off the stitches the latches of the two knitting needles 40 and 42 are initially held open, as best shown in FIG. 4 to the rear. As shown in FIG. 3 the right stitch row, shown below in FIG. 3, is formed on the outer border of the belt material 30 whereas the left one, shown at the top in FIG. 3, is however formed somewhat inside of the outer border of the belt material.

After outward swinging of the weft needles 26 and 28 and beating up by the reed 32 the sheds are changed. For renewed insertion the lower weft needle 28 moves again through the two sheds 38 and 39 whereas the weft needle 26 again only goes through the main shed 39.

Description of second working embodiment.

FIG. 5 shows belt material without border portions. The belt material is woven using two oppositely moving weft needles 26 and 28, a single shed being formed in each case. In the case of the belt material illustrated here the monofilament 10 is below and the multifilament 12 on top, this however not being significant in principle. The heads 60 of the weft loops of the multifilament 12, at the right in FIG. 5, are secured by a row of stitches 62, which is formed by an auxiliary thread 64. The heads 66 protruding to the left of the weft loops of the monofilament 10 are secured by a row 68 of stitches, which is formed by an auxiliary thread 70.

Preferably weft threads 10 and 12 of approximately 550 dtex are employed and preferably the auxiliary threads 64 and 70 are of up to 1,100 dtex.

For weaving the belt material only one shed is formed, through which both weft needles are guided. The arrangement and the workings of the knitting needles 40 and 42, of the latch retaining wires 44 and 46 and of the thread guides 48 and 50 are the same as described with reference to FIGS. 2 through 4. As shown in FIG. 5 the rows of stitches 62 and 68 are knitted using auxiliary threads 64 and 70, which are substantially thicker than the weft threads 10 and 12. Therefore soft outer borders are formed, which reliably cover over the heads 60 and more particularly the heads 66.

I claim:

1. A method of weaving belt material on a needle belt loom comprising a reed and sheds; further comprising two oppositely moving weft needles supplying weft threads, characterized by the following steps:

beating up with the reed and changing over the sheds by forming a fully open main shed for both weft needles of warp threads of a center part of the belt material, the center part having two sides, the two sides having outer border positions;

jointly weaving the center of the belt material by both weft needles;

weaving by only one of the two weft needles two border portions on the two sides of the center part of the belt material, the border portions having an inner edge forming a partly open shed on both sides of the center part by border portion warp threads;

moving one of the weft needles for each weft insertion through the fully open shed and the two partly open sheds;

moving the other weft needle through the fully open shed only, weaving only with the warp threads of the center part;

weaving weft loops with the warp threads of a first border portion, forming first heads, securing the heads by forming a fist row of stitches arranged externally on the first border portion by an auxiliary thread;

weaving weft loops with the center part warp threads, forming second heads; and securing the second heads by forming a second row of stitches formed by an auxiliary thread arranged at one of the outer borders of the center part and an inner edge of the adjacent second border portion.

2. The method as claimed in claim 1, including the step of utilizing a monofilament thread for the weft thread only woven with the warp threads of the center part.

3. The method as claimed in claim 1, including the step of utilizing a monofilament thread for the weft loops woven with the warp threads of the center part.

4. The method as claimed in claim 1, including the steps of selecting the two weft loops with at least the same d tex weight and selecting the auxiliary threads with at least approximately half the weight thereof.

5. A method of weaving belt material on a needle belt loom having a reed and sheds, having two oppositely moving weft needles each having a weft thread having at least approximately the same d tex weight comprising the steps of:

beating up with the reed and changing over the shed, inserting both weft needles into a common shed;

weaving the belt material by both weft needles, said belt material having two outer borders;

forming oppositely inserted weft loops having heads by return movement of the weft needles;

forming two rows of stitches, each row being formed by one auxiliary thread having at least approximately double the weight of the weft threads;

arranging the rows on the two outer borders of the belt material;

securing the heads of the oppositely inserted weft loops by the two rows of stitches.

* * * * *